US008763711B2

(12) United States Patent
Stephens

(10) Patent No.: US 8,763,711 B2
(45) Date of Patent: Jul. 1, 2014

(54) DRY PIPE SPRINKLER SYSTEM

(75) Inventor: John Nigel Stephens, Harpenden (GB)

(73) Assignee: Building Research Establishment Ltd, Watford (GB)

( * ) Notice: Subject to any disclaimer, the term of this patent is extended or adjusted under 35 U.S.C. 154(b) by 932 days.

(21) Appl. No.: 12/919,203

(22) PCT Filed: Feb. 24, 2009

(86) PCT No.: PCT/GB2009/000505

§ 371 (c)(1),
(2), (4) Date: Feb. 22, 2011

(87) PCT Pub. No.: WO2009/106806

PCT Pub. Date: Sep. 3, 2009

(65) Prior Publication Data

US 2012/0031630 A1 Feb. 9, 2012

(30) Foreign Application Priority Data

Feb. 25, 2008 (GB) ..... 0803357.3

(51) Int. Cl.
*A62C 35/00* (2006.01)

(52) U.S. Cl.
USPC ..... 169/17; 169/19; 169/20; 169/23; 169/61

(58) Field of Classification Search
USPC ..... 169/17, 19, 20, 23, 56, 60, 61, 21, 22
See application file for complete search history.

(56) References Cited

U.S. PATENT DOCUMENTS 2,086,438 A 7/1937 Rowley
2,251,422 A 8/1941 Rider (Continued)

FOREIGN PATENT DOCUMENTS

GB 27196 0/1912
GB 107368 4/1918

(Continued)

OTHER PUBLICATIONS

British Search Report, dated Apr. 10, 2008, corresponding to GB0803357.3, 1 pg.

(Continued)

*Primary Examiner* — Steven J Ganey
(74) *Attorney, Agent, or Firm* — Christie, Parker & Hale, LLP

(57) ABSTRACT

A dry pipe sprinkler system comprises at least one sprinkler head (18); a control valve (10) operable to supply an extinguishant to the sprinkler head; a system of pipes (16) interconnecting the control valve and the sprinkler head, the pipe system comprising a control column (26) and a riser pipe (42); and a pressure control means (38) located downstream of the control valve and upstream of the sprinkler head; wherein the pipe system is arranged to form a manometer which contains a quantity of extinguishant up to a predetermined level (48) in the control column and in the riser pipe; wherein the manometer is arranged such that the creation of a pressure differential across the pressure control means results in a reduction in the extinguishant level in the control column and a rise in the extinguishant level in the riser pipe; and wherein the control valve is adapted to open to supply extinguishant to the sprinkler head when there is a change in the predetermined level of extinguishant in the control column and/or the riser pipe.

22 Claims, 2 Drawing Sheets

(56) References Cited

U.S. PATENT DOCUMENTS

Figure 1:
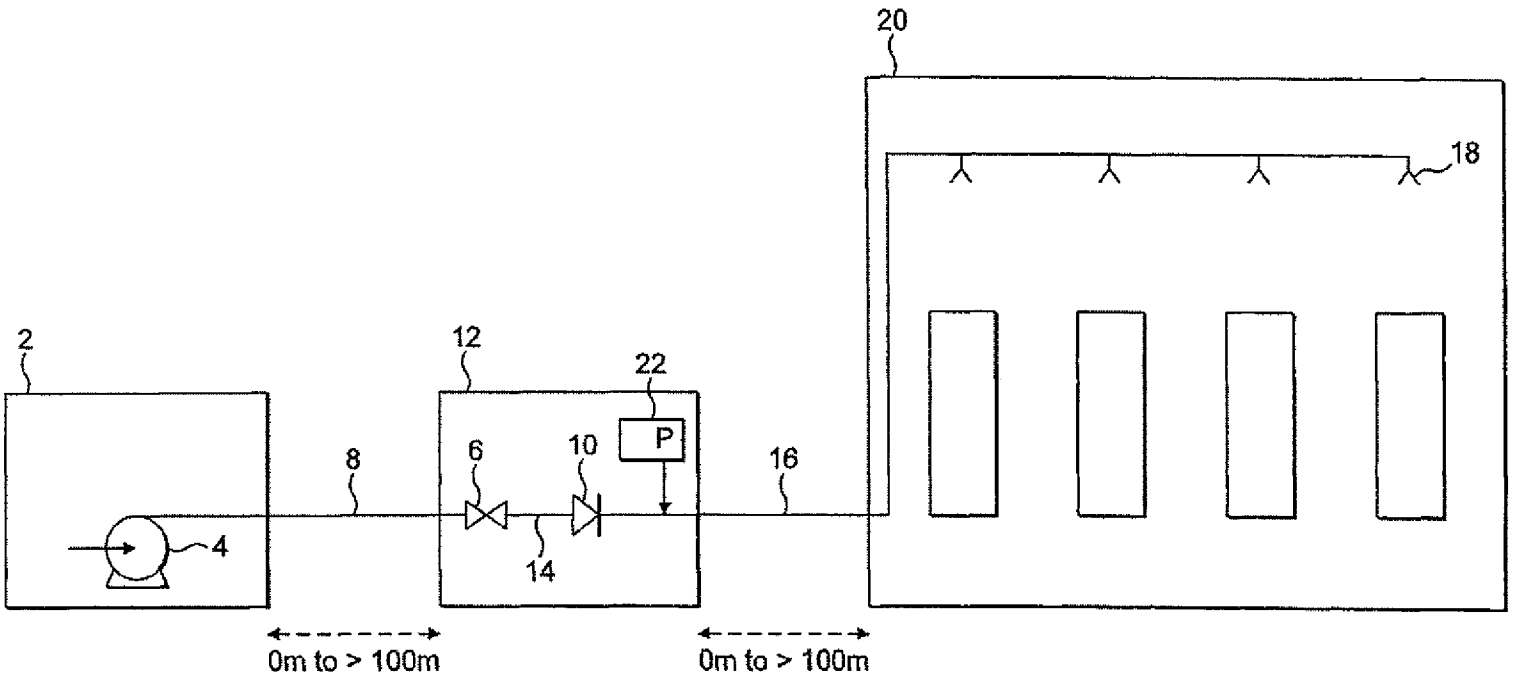

| | | | | |
|---|---|---|---|---|
| 5,027,905 | A | 7/1991 | Cousineau et al. | |
| 5,236,049 | A | 8/1993 | Asselin et al. | |
| 5,971,080 | A | 10/1999 | Loh et al. | |
| 6,068,057 | A | 5/2000 | Beukema | |
| 6,357,531 | B1 * | 3/2002 | Asselin | 169/17 |
| 6,848,513 | B2 * | 2/2005 | Jackson et al. | 169/19 |
| 2002/0121381 | A1 | 9/2002 | Reilly | |
| 2004/0013990 | A1 | 1/2004 | Haefner et al. | |

FOREIGN PATENT DOCUMENTS

| | | |
|---|---|---|
| GB | 181862 | 6/1922 |
| GB | 217079 | 6/1924 |
| GB | 318790 | 9/1929 |
| GB | 415935 | 9/1934 |
| GB | 430028 | 6/1935 |
| GB | 1411470 | 10/1975 |
| WO | WO 99/59679 | 11/1999 |

OTHER PUBLICATIONS

International Search Report, dated Jun. 3, 2009, corresponding to PCT/GB2009/000505, 4 pages.

Written Opinion, dated Jun. 3, 2009, corresponding to PCT/GB2009/000505, 11 pgs.

* cited by examiner

-- PRIOR ART --

DRY PIPE SPRINKLER SYSTEM

CROSS-REFERENCE TO RELATED APPLICATION

This application is a National Phase Patent Application and claims the priority to and the benefit of International Application Number PCT/GB2009/000505, filed on Feb. 24, 2009, which claims priority to and the benefit of British Patent Application Number 0803357.3, filed on Feb. 25, 2008.

The present invention relates to a dry pipe sprinkler system.

Dry pipe sprinkler systems are used instead of wet pipe sprinkler systems in situations where water would freeze in pipes (ie when the temperature falls below zero degrees C.). Examples are freezers, chilled storage or unheated areas such as car parks, storage areas and loading bays. Here the conditions are sufficiently cold that if a wet pipe sprinkler system was installed, the water would freeze in the pipes and therefore be ineffective in the event of a fire.

In common with wet pipe sprinkler systems, a dry pipe sprinkler system has sprinkler heads through which water is directed to suppress and control fires. It also has a system of pipes, valves, a pump and a water supply. In these systems, a sprinkler pump, a dry pipe control valve, a water supply and associated pumps are sited in areas of the property where the water will not freeze.

The main distinction between a wet pipe sprinkler system and a dry pipe sprinkler system is that a dry pipe sprinkler system is charged with gas such as air or nitrogen. In particular, the pipe system between the dry pipe control valve and the or each sprinkler head is filled with gas under pressure. When the or each sprinkler head is closed, the dry pipe control valve is held closed by gas pressure in the pipe system downstream of the valve. Water is present in the pipe system upstream of the control valve. When a sprinkler head opens, the gas pressure in the pipe system drops due to the flow of the gas out of the open sprinkler head. Consequently, the control valve opens and water flows through the sprinkler head so that the suppression and control operation is initiated.

Currently there are two types of dry pipe control valve commonly available. These are a differential dry pipe valve and a mechanical dry pipe valve (having for example levers, latches and/or links), both of which valves have similar performance characteristics. The ratio of gas pressure to water pressure for installations and valve operations is specific to each valve type.

Differential dry pipe sprinkler valves function on the principle that the upstream surface of the valve clack which is impressed by the installation gas pressure is greater in area than the downstream valve clack surface which is subjected to water pressure. The ratio of upstream to downstream clack area may be of the order of 6:1. In contrast, mechanical valves usually have a relatively small differential and depend on a pressurised side diaphragm imposing a closing force on the valve clack through shafts, links or levers. Pressurisation of the diaphragm may be from the gas in the installation or hydraulically from the water supply. Typically, valve manufacturers specify the minimum gas pressure required for a given water standing supply pressure, allowing a suitable safety margin. Usually an installation gas pressure of 3.5 bar is sufficient to maintain a dry pipe valve closed for a water supply pressure up to 12 bar. Whichever type of valve is used, the valve will open when the closing force on the upstream side of the clack is exceeded by the force exerted on the downstream side by the water supply.

When a sprinkler head opens, gas pressure is lost through the open sprinkler head faster than it is made up by the gas supply to the system. Once the gas pressure is reduced to a specific value, the dry pipe control valve opens. This time period is referred to as 'trip time'. Water then flows into the pipe system. However, water does not flow out of the open sprinkler head until the gas has been purged from the pipe system via the open sprinkler head. This time period is referred to as 'transit time'.

A quick opening device, either an accelerator or an exhauster, can be added to standard dry pipe installations to improve the trip time. It detects the rate of pressure decay quicker than a standard dry pipe valve detects pressure loss. The quick opening device then opens the dry pipe valve. In this respect, accelerators open the dry pipe valve by redirecting the pressurised gas to force the valve open. In contrast, exhausters increase the rate of gas discharged from the sprinkler system.

FIG. 1 is a schematic diagram of a typical dry pipe sprinkler installation for high hazard storage in a cold store building. Pallets are shown in the cold store building (ie post pallet storage). A pump house 2 located outside the cold store building houses a pump 4. The pump is connected to a stop valve 6 via a water charged pipe 8. The stop valve and a dry pipe control valve 10 are located in a valve room 12. A pipe 14 that is water-charged connects the stop valve and the control valve. Downstream of the control valve 10 is a pipe system 16 which connects the control valve to the sprinkler heads 18 in the cold store building 20. The pipe system 16 is charged with gas using a gas supply 22 located downstream of the control valve and located in the valve room 12.

The effectiveness of sprinkler protection in buildings is influenced by the time taken for the water to be delivered onto a fire. If the delay between sprinkler operation and water discharge is too long, the sprinkler system is unlikely to control the fire, since the fire may have grown too large to be controlled by the water delivered by the sprinkler system.

The trip time can be excessive if large volumes of pressurised gas need to be purged from the system before the control valve opens. When dry pipe control valves are used the gas pressure is typically one third of the water pressure. The valve opens when the gas pressure to water pressure ratio is typically one to six.

The transit time depends on the system design. The transit time is increased for higher gas pressures, larger internal volumes of pipe work, where fittings create resistance to the flow of gas being purged from the system and where the pipe work is laid out such that a larger percentage of gas needs to be purged from the system. The volume of pipe work that is charged with gas is often large since the dry pipe control valve is installed outside the building where the sprinkler heads are located. It is noted that exhausters assist the transit time whilst accelerators do not.

A problem with standard dry pipe sprinkler systems is that the purging of pressurised gas, the control valve operating times and the time taken to charge the dry pipes with water results in delays in discharging water from the open sprinkler heads.

Whilst quick opening devices significantly improve the trip time, they are prone to blockage of control orifices and to failure. This is because, to detect pressure losses, quick opening devices employ multiple chambers linked by small communication ports and orifices and may have small moving parts. The small openings are prone to clogging and blockage and the moving parts are prone to sticking. Hence, costly, regular manual maintenance is required. Moreover, these quick opening devices can be oversensitive to fluctuations in environmental temperature.

The present invention seeks to provide a dry pipe sprinkler system that delivers water to open sprinkler heads more quickly than achieved by standard dry pipe sprinkler systems.

According to the present invention there is provided a dry pipe sprinkler system comprising: at least one sprinkler head; a control valve operable to supply an extinguishant to the sprinkler head; a system of pipes interconnecting the control valve and the sprinkler head, the pipe system comprising a control column and a riser pipe; and a pressure control means located downstream of the control valve and upstream of the sprinkler head; wherein the pipe system is arranged to form a manometer which contains a quantity of extinguishant up to a predetermined level in the control column and in the riser pipe; wherein the manometer is arranged such that the creation of a pressure differential across the pressure control means results in a reduction in the extinguishant level in the control column and a rise in the extinguishant level in the riser pipe; and wherein the control valve is adapted to open to supply extinguishant to the sprinkler head when there is a change in the predetermined level of extinguishant in the control column and/or the riser pipe.

The presence of a manometer allows lower gas pressures to be used and allows partial filling of the pipe system with extinguishant.

The control valve may be a dry pipe valve, such as a mechanical valve (eg latched) or a wet valve.

In a stand-by condition, the dry pipe sprinkler system is charged with pressurised gas downstream of the control valve and above the level of extinguishant in the manometer. The dry pipe sprinkler system preferably comprises a means for containing a volume of gas (for example a reservoir which may be a vessel (eg a cylinder) or a large volume of pipes), preferably provided with a pressure relief valve, to supply pressurised gas to the pipe system. The dry pipe sprinkler system preferably comprises at least one anti-flooding device; it may comprise at least two anti-flooding devices, between which the means for containing a volume of gas and the pressure control means are preferably connected to the pipe system, in order to keep this section of the pipe system dry in use.

Preferably, the pressure control means is adapted to delay equalisation of gas pressure on either side thereof when there is a sudden reduction in the gas pressure on one side thereof. The pressure control means preferably comprises at least one control orifice together with means for containing a volume of gas. The or each control orifice may be at least 2 mm in diameter, for example at least 2.5 mm. Preferably it is at least 5 mm in diameter. The diameter of the control orifice is preferably sufficiently large to avoid problems associated with dirt which causes blockages.

Preferably, the dry pipe sprinkler system comprises at least one means for sensing the level of an extinguishant in the control column and/or the riser pipe. The level sensing means may be located in or adjacent to the control column and/or the riser pipe.

This level sensing means is adapted to detect a change in the predetermined level of extinguishant in the control column and/or the riser pipe. In one embodiment, on detecting a change in the predetermined level of extinguishant, the level sensing means is adapted to control the opening of the control valve. This may be achieved by sending a signal to the control valve to cause it to open.

Preferably, the level sensing means comprises a probe that is linked to the control valve.

Preferably a topping-up means is provided and is operable to admit extinguishant into the pipe system to keep the extinguishant up to said predetermined level in the stand-by condition of the sprinkler system. The topping-up means may be located in the control column or the riser pipe above the level sensing means.

Preferably a draining means is provided and is adapted to discharge extinguishant from the pipe system if the level of the extinguishant rises above said predetermined level in the stand-by condition of the sprinkler system. The draining means may be located in the control column or the riser pipe above the level sensing means.

Preferably the diameter of the control column is less than that of the riser pipe.

In one embodiment, the pipe system comprises a first pipe sub-system and a second pipe sub-system, wherein the control column and the riser pipe are each connected between the first pipe sub-system and the second pipe sub-system.

In one embodiment, the control column and the riser pipe are vertically-oriented. However, they do not need to be vertically-oriented. They can be oriented at any angle at which the level sensing means is able to detect a change in the predetermined level of extinguishant in the control column and/or the riser pipe. This may, in practice, be any angle of ±45° to the vertical, more likely any angle of ±10° to the vertical.

Preferably, the first pipe sub-system is charged with extinguishant when the system is in its stand-by condition. Preferably, the second pipe sub-system is charged with pressurised gas when the system is in its stand-by condition.

The topping-up means and the draining means may be located anywhere in the first pipe sub-system.

The pressure control means, one or more sprinkler heads and/or one or more anti-flooding devices may be installed in the second pipe sub-system.

The manometer within the dry pipe sprinkler system responds quickly to a pressure change in the system induced by the activation of a sprinkler head. The time period to achieve a significant manometer displacement is relatively short.

It will be appreciated that the dry pipe sprinkler system according to the invention enables the quick opening device of a conventional dry pipe sprinkler system to be dispensed with, so that operation of the sprinkler system is not dependent on a quick opening device functioning correctly.

The dry pipe sprinkler system according to the invention relies on a minimal number of moving parts, thereby reducing the problems associated with sticking parts.

The control orifices of the pressure control means are relatively large, so that small, slow pressure changes due to temperature fluctuations should not cause significant manometer displacements or false detections.

Figure 2:
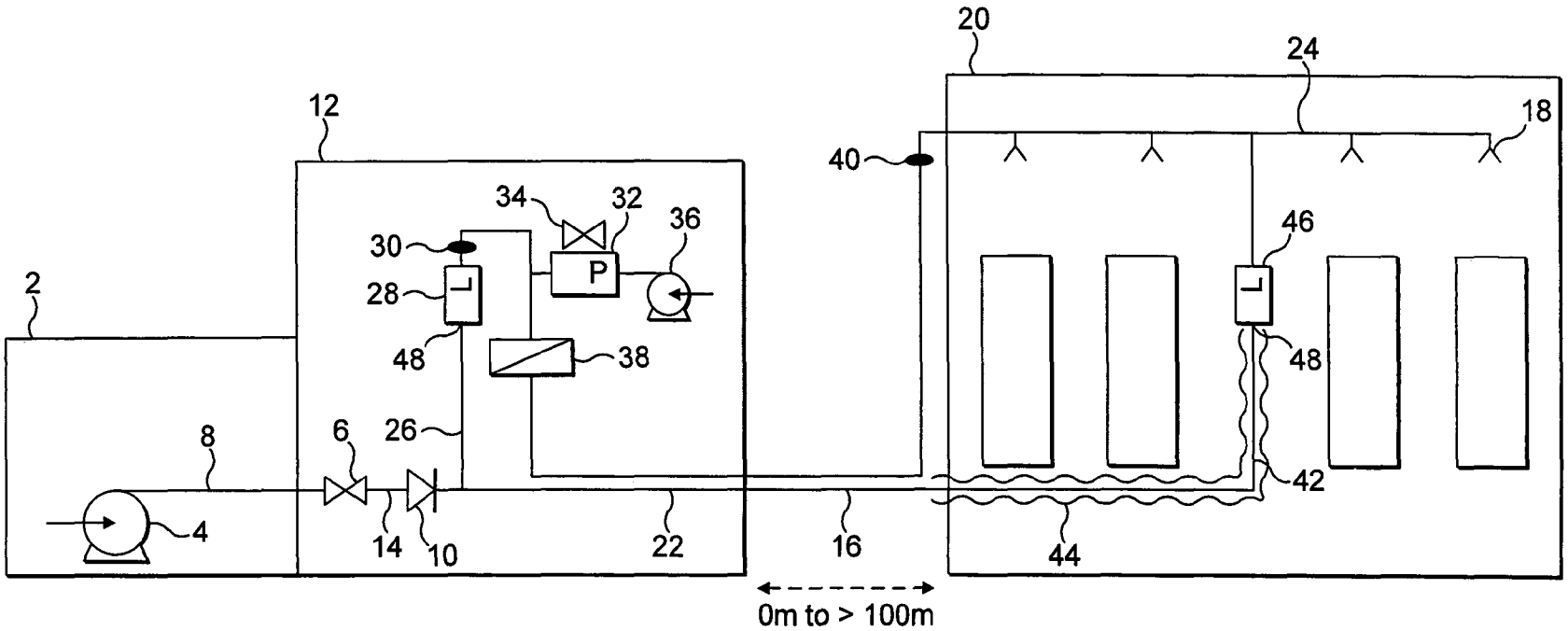

Embodiments of the present invention will now be described, by way of example only, with reference to the accompanying diagrammatic drawings, in which:

FIG. 1 shows the layout of a standard (prior art) dry pipe sprinkler system; and FIG. 2 shows the layout of a dry pipe sprinkler system in accordance with the present invention.

Referring to FIG. 2, a dry pipe sprinkler system is installed for a cold store building, or similar. A pump house 2, located outside the cold store building, houses a pump 4. The pump forces extinguishant, water in this case, into the sprinkler system to suppress and control fire. The pump is connected to a stop valve 6 via a water charged pipe 8. The stop valve 6 enables the sprinkler system to be isolated from the water supply (not shown) such as mains water or a supply tank. The stop valve and a dry pipe control valve 10 are located in a valve room 12. A pipe 14 that is water charged connects the stop valve and the control valve. In an alternative embodiment, the stop valve and the control valve are bolted together, so pipe 14 is not required. Downstream of the control valve 10 is a pipe system 16 which connects the control valve 10 to sprinkler heads 18 in the cold store building 20. The pipe system is partially charged with water and partially charged with gas (eg air). The pipe system comprises a first (lower) pipe sub-system 22 and a second (upper) pipe sub-system 24. It is arranged to form a manometer.

The sprinkler heads 18 may comprise a heat sensitive valve and a deflector or spraying mechanism so that if a predetermined ambient temperature is reached the valve is opened to allow extinguishant to be sprayed over the floor area beneath. Alternatively, the heads may comprise simple spraying mechanisms, an alternative heat sensitive mechanism being used to trigger the supply of extinguishant to the heads. The sprinkler heads may have a nozzle with an orifice of 11 mm (a K80 Sprinkler) for discharging extinguishant.

The control valve 10 is linked to a conventional alarm system (not shown) and can comprise either a differential or mechanical dry pipe valve, a deluge valve or a wet valve; it is preferably a wet valve or a mechanical dry pipe valve. When the system is in its normal stand-by condition, the control valve remains closed. However, on detection of a fire, the control valve is actuated (some modification of a standard control valve may be required to achieve this in the present system) and opens to permit extinguishant to flow into the pipe system 16 from the supply. At the same time, the pump 4 is switched on.

Actuation of the control valve 10 is controlled by the use of a control column 26. In the present embodiment, this control column comprises a vertical pipe linked at one end (its lower end) to the lower pipe sub-system 22 and at its other end (its upper end) to the upper pipe sub-system 24.

Between the upper end of the column 26 and the sprinkler heads 18, the upper pipe sub-system 24 comprises: a first manometer level measuring device (or level sensing means) 28; a first anti-flood device 30; a gas reservoir 32 having a pressure relief valve 34 and a gas supply 36; a pair of manometer orifice plates 38; and a second anti-flood device 40.

The manometer orifice plates define two control orifices which comprise a pressure control means for the sprinkler system. Connected upstream to the control orifices is the gas reservoir which is in turn connected to gas supply 36 for providing pressurised gas to maintain a suitable pressure in the system. The control orifices mean that the gas reservoir side of the manometer is not a closed system. The orifices ensure that in static conditions (sprinkler closed) the pressure in the system is equal, irrespective of small fluctuations due to temperature or leaks. In dynamic conditions (sprinkler open), the orifices are sufficiently small to ensure that gas loss from the reservoir is controlled. In another embodiment, a single control orifice is used. In a further embodiment, more than two control orifices are used.

In one example, to provide a control orifice, a plate having a circular orifice drilled therethrough is mounted, together with two gaskets, between a pair of flanges which are bolted together. The flanges are steel with a 100 mm body and a 15 mm internal bore. The orifice plate is aluminium, is 300 mm wide by 100 high and has an orifice with a diameter of 2.5 mm. In an alternative example, three plates are mounted in series between the flanges, each having a control orifice of 4 mm. Of these, the use of larger orifices is preferred in order to reduce the risk of blockage. However, this is balanced against the undesirable result that the larger the orifice, the decrease in displacement of extinguishant in the manometer and in the duration of this displacement. It is noted that increasing the gas pressure in the system results in an increase in this displacement and its duration, together with a quicker response time for the movement of extinguishant into the system, once activated. However, this will delay transit time and water delivery, so a compromise needs to be found when designing and installing a system. It is also noted that the volume of piping used in the pipe system upstream of the control orifices should be kept to a minimum, in order to maximise the displacement of extinguishant in the manometer and to shorten the response time for the movement of extinguishant.

The manometer orifice plates 38 are connected into the sprinkler system between the two anti-flooding devices 30 and 40. Each anti-flooding device comprises a valve wherein a ball with a density less than that of the extinguishant is located within a cage. The outlet from each anti-flooding device is at the top of the cage, which forms a seat into which the ball floats when the cage is flooded.

The first manometer level measuring device (or level sensing means) comprises a conductivity probe, for example. When the water level in the control column drops to a certain level, the water loses contacts with the probe which sends a signal to the control valve. This causes the control valve to open, so that water extinguishant is pumped into the pipe system to the sprinkler heads.

Located vertically above the first manometer level measuring device in the control column is a top-up probe (not shown). This probe is linked to a water or extinguishant supply, such as mains water or the supply tank. Located vertically above the top-up probe in the control column is a drain probe which is connected to a drain. These probes are discussed further below.

Lower pipe sub-system 22 is connected at one end to control valve 10 and at another end to a riser pipe 42 and is charged with water. Thus the piping immediately downstream of the control valve is filled with water. The riser pipe is located within the cold store building (although it could also be located outside the cold store building), meaning that the lower pipe sub-system is also partly located within the cold store building. Since this pipe sub-section is water-charged, it is important to ensure that the water therein does not freeze. This can be accomplished by using an extinguishant capable of remaining liquid at low temperatures, such as a mixture of water and an anti-freeze preparation, or by ensuring that the pipes are thermally insulated and heated or located in areas of the building which are heated. In FIG. 2, there is insulation 44 around the section of the lower pipe sub-system located within the cold store building, and also around the lower section of the riser pipe, this section being water-filled: in addition, trace heating is used to prevent the water from freezing.

The diameter of the control column is preferably smaller than that of the riser pipe. This provides a greater water level displacement in the control column than in the riser pipe. The greater the water level displacement, the more readily it can be detected by the manometer level measuring device 28.

To maintain the water level in the pipe system, so that a water level displacement does not accidentally open the control valve, small water losses due to leaks can be detected by the water top-up probe (alternatively a stop-cock or similar mechanical system could be used). This probe signals, when the water drops to a certain level, that a water supply valve should be opened. The water is then topped up, via the valve, at a low flow rate thereby ensuring that the rate of topping up is sufficiently slow to prevent obscuring a manometer displacement. The valve is closed when the water level rises above the probe.

To prevent overfill of the system with water, the water drain probe (not shown) detects overfill and signals to open a small water drain (not shown). The excess water is drained off through the drain. The drain is closed once the water level falls below the probe.

These probes allow the sprinkler system to be continuously self-monitoring and self-correcting, such that manual checking and maintenance is not required.

The riser pipe 42 is located between the lower pipe sub-system 22 and the upper pipe sub-system 24. In this embodiment, the riser pipe comprises a vertical pipe linked at one end (its lower end) to the lower pipe sub-system and at its other end (its upper end) to the upper pipe sub-system. The riser pipe is located in the cold store building. It therefore connects to the upper pipe sub-system adjacent the sprinkler heads.

The riser pipe is partially filled with water. In the stand-by condition of the system, the water reaches predetermined level 48. Located vertically above this level is a second manometer level measuring device 46. This detects when the water level has risen to a certain level. This second manometer level measuring device (or level sensing means) comprises a conductivity probe, for example, which detects water coming into contact with it. Instead of, or in addition to, the first manometer level measuring device, when the water contacts the probe of the second manometer level measuring device, a signal is sent to the control valve to cause it to open. It is noted that having two manometer level measuring devices is optional since one is sufficient, although it is useful to have a second one to use as a back-up. The riser pipe is charged with pressurised gas above its water level.

In the sprinkler system, the control column 28, the riser pipe 42, and the connecting pipes therebetween form a manometer in the stand-by condition of the system, the system containing a quantity of water or other extinguishant up to a predetermined level 48. The level 48 is predetermined normally to lie vertically above the water top-up probe.

Above the level 48 of the extinguishant in the control column 26 and the riser pipe 42, the sprinkler system is charged with pressurised gas from gas supply 36 (the gas being pressurised using a compressor or other source of compressed gas) via the gas reservoir 32. The gas reservoir is provided with a pressure relief valve 34. The gas reservoir 32 is connected to the upper pipe sub-system upstream of the manometer orifice plates 38 and downstream of the first anti-flooding device 30.

The gas reservoir 32 feeds pressurised gas into the system when required. The gas is able to flow from the system back into the reservoir 13 to equalise any fluctuations in pressure owing to temperature changes. The gas filled sections of the pipe system are charged at a relatively low standby pressure, for example 2 bar or less, preferably 1 bar or less, more preferably about 0.5 bar.

In operation, in the stand-by condition, the gas pressure in the system will be in equilibrium and will be the same on both sides of the control orifices.

In common with all dry pipe sprinkler systems, it is important to maintain the correct gas pressure. The gas pressure is continuously measured and top-up gas added at a slow rate, as required. The gas supply is installed so that its operation does not accidentally operate the manometer signal. Hence, it is installed with at least one control orifice (that of a manometer orifice plate) to ensure a low flow rate. Alternatively it could be sited between a pair of control orifices, so that the impact of its operation is balanced on each side of the manometer.

To prevent over-pressurisation of the gas, the pressure relief valve 34 is used with an appropriately selected setting. When the gas pressure rises above a preset level, the pressure relief valve opens, and closes when the level is restored. The pressure relief valve also has an additional advantage since it can act as an exhauster. After opening of the control valve, it provides a second route for gas discharging from the pipe system. Once water has reached the first anti-flooding device, this device prevents water from entering the dry pipe system downstream of the anti-flooding device.

Should a fire break out, the sprinkler heads 18 closest thereto will operate and gas will discharge from the pipe system, rapidly reducing the pressure therein. Gas will also flow from the reservoir 32 and the control column 26 via the control orifices. However, providing the reservoir 32, the control column volume above the predetermined extinguishant level 48, and the control orifice diameter are appropriately sized, the pressure will decay at a slower rate within the control column 26 than in the rest of the pipe system and, in particular, than in the riser pipe 42. The creation of a positive pressure differential across the control orifices of the manometer orifice plates will result in a reduction in the level of the extinguishant within the control column below the normal stand-by level 48 and a corresponding rise in the level within the riser pipe, owing to the manometer arrangement between them. This drop in the water level in the control column can take place in seconds (even in one second), so the water top-up probe does not have time to admit additional extinguishant into the system. The water level is therefore able to drop to a level below the first manometer level measuring device in the control column. The water level is also able to rise to the level of the second manometer level measuring device in the riser pipe. The displacement in the water level is detected by the probe of the first and/or second manometer level measuring device. This device sends a signal to the control valve which causes it to open.

The pump 4 is switched on when the control valve 10 is actuated and extinguishant is thereby pumped rapidly into the system to the operating sprinkler heads 18 via the riser pipe for discharge on to the fire. The main fire alarm is also switched into operation.

The anti-flooding devices 30, 40 also act to increase the extinguishant inflow rate into the pipe system after actuation of the system. Since the gas reservoir remains connected to the system during its filling with extinguishant, the pressure relief valve 34 will effectively act as an exhauster until the extinguishant reaches and closes both the anti-flooding devices, the extinguishant coming via the lower pipe sub-system. In addition, the two anti-flooding devices prevent the gas reservoir from filling with extinguishant so that extinguishant will not, thereby, be discharged from the system via the pressure relief valve, which would be both wasteful and an unnecessary demand on the extinguishant supply. A further advantage of this is that the gas reservoir will not ultimately require draining when the system is reset.

Design features which influence the reaction time of the system to trip the control valve 10 and initiate extinguishant flow into the system are the following:

1. control orifice diameter (Dc);
2. gas reservoir and control column volume above the extinguishant level (Vc) on one side of the control orifice or orifices;
3. system volume above the extinguishant level (Vi) on the other side of the control orifice or orifices;
4. relative cross-sectional areas of the control column 26 and the riser pipe 42;
5. system stand-by gas pressure (Pi); and
6. sprinkler orifice diameter (Di).

Once extinguishant flow into the system has commenced, the factors which will influence the time taken for it to be discharged from the sprinkler heads are as follows:

1. sprinkler orifice diameter (Di);
2. total system volume above the predetermined extinguishant level (Vc+Vi);
3. residual gas pressure in the system (Pi);

4. water supply characteristics; and 5. pipe network arrangement.

Advantages of the present invention are that it provides a low stand-by gas pressure; quick detection of pressure loss when the sprinkler heads open; and lower gas-charged system volume when compared to a standard dry-pipe system; these thereby resulting in a shorter delay time between actuation of the control valve 10 (trip time) and discharge of extinguishant by the sprinkler heads 18 (transit time).

In the present invention, the system in its stand-by condition is partially filled with extinguishant by having it in the riser pipe 42 and in the lower pipe sub-system 22 upstream of the riser pipe. There is therefore less gas to discharge from the system. The system volume (Vi), being gas-filled, can mainly comprise small diameter distribution and range pipes. The distance between the control valve 10 and the sprinkler heads 18 is no longer a limiting factor amongst those influencing the time taken for extinguishant discharge.

In addition to the above, it can be shown that the pressure differential generated across the control orifice Pc-Pi, where Pc is the gas reservoir pressure, for a number of different design variables comprising Dc, Di, Vc, Vi and Pi is sufficient to permit the control orifice to be made large enough, for example between 2 mm and 8 mm inclusive and preferably of the order of 5 mm, for it to be unlikely to cause problems in practice owing to blockage. Typical ranges of values for these design variables are as follows, assuming the upper pipe sub-system 24 to be of conventional range pipe size, namely 50 mm diameter pipe, immediately upstream of an open sprinkler head, which is itself of conventional design:

Di=10.9 mm to 16 mm

Pi=0.25 bar to 3.5 bar

Vc=0.025 $m^3$ to 0.5 $m^3$

Vi=0.3 $m^3$ to 5.0 $m^3$

Particular design variables will, of course, depend on the design criteria required for any given building to be sprinkler-protected, but it will be appreciated that the ranges quoted will enable the dry pipe sprinkler system to be customised for the building in question.

When a control orifice having a supporting gas reservoir is connected to the pipe system, the rate of pressure loss from the reservoir is slower than in the pipework (using 2.5 mm control orifice, 8 mm sprinkler head nozzle, with 25 liter gas reservoir and 1320 liter pipe system pressurised to 50 kPa (0.5 bar)) and a slight reduction in pressure loss is observed. This pressure difference is observed using the manometer. In one example, it took 1 second to establish a reliable manometer reading, when a sprinkler head nozzle was opened.

In the embodiment of the present invention described and shown, the pipes and other elements in the system are sometimes described as vertical or as being vertically-oriented with respect to one another or are shown in a vertical or horizontal orientation. This is non-limiting. The pipes and other elements in the system can be oriented in any direction, so long as the resulting system is functional.

The present invention seeks to provide a dry pipe sprinkler system with the following potential advantages over conventional arrangements:

1. a reduction in the time taken to trip the dry pipe control valve;

2. a reduction in the system pressure and therefore in the transit time;

3. a reduction in the gas charged system volume which can result in shorter delay times to extinguishant discharge or larger sprinkler array areas for a given system, or possibly both;

4. the elimination of the distance between the system sprinkler array and the dry pipe control valve being a factor in system performance;

5. a self-monitoring system;

6. a control orifice that can be a relatively large diameter, as compared with a quick opening device orifice, and thus be less likely to malfunction;

7. the performance of a specific system in terms of the time to extinguishant discharge that is predictable at the design stage and verifiable at commissioning;

8. fine tuning a system after completion to achieve a required extinguishant discharge time by changing the control column sensitivity (height) or the control orifice diameter, or both, or by increasing the volume Vr, which would decrease the trip time; and 9. achieving reliable extinguishant discharge times that would make the invention suitable for protecting high risk storage areas, car parks and loading bays, for example

The invention claimed is:

1. A dry pipe sprinkler system comprising:

at least one sprinkler head;

a control valve operable to supply an extinguishant to the sprinkler head;

a system of pipes interconnecting the control valve and the sprinkler head, the pipe system comprising a control column and a riser pipe; and a means for controlling pressure located downstream of the control valve and upstream of the sprinkler head;

wherein the pipe system is arranged to form a manometer which contains a quantity of extinguishant up to a predetermined level in the control column and in the riser pipe;

wherein the manometer is arranged such that the creation of a pressure differential across the means for controlling pressure results in a reduction in the extinguishant level in the control column and a rise in the extinguishant level in the riser pipe; and wherein the control valve is adapted to open to supply extinguishant to the sprinkler head when there is a change in the predetermined level of extinguishant in the control column and/or the riser pipe.

2. A dry pipe sprinkler system as claimed in claim 1, wherein in a stand-by condition, the dry pipe sprinkler system is charged with pressurised gas downstream of the control valve and above the level of extinguishant in the manometer.

3. A dry pipe sprinkler system as claimed in claim 1, further comprising means for containing a volume of gas to supply pressurised gas to the pipe system.

4. A dry pipe sprinkler system as claimed in claim 3, wherein the means for containing a volume of gas further comprises a pressure relief valve.

5. A dry pipe sprinkler system as claimed in claim 1, further comprising at least one anti-flooding device.

6. A dry pipe sprinkler system as claimed in claim 1, wherein the means for controlling pressure is adapted to delay equalisation of gas pressure on either side thereof when there is a sudden reduction in the gas pressure on one side thereof.

7. A dry pipe sprinkler system as claimed in claim 1, wherein the means for controlling pressure comprises at least one control orifice and means for containing a volume of gas.

8. A dry pipe sprinkler system as claimed in claim 7, where the or each control orifice is at least 2 mm in diameter, preferably at least 5 mm in diameter.

9. A dry pipe sprinkler system as claimed in claim 7, further comprising at least one means for level sensing of an extinguishant in the control column and/or in the riser pipe.

10. A dry pipe sprinkler system as claimed in claim 9, wherein the level sensing means is located in or adjacent to the control column and/or the riser pipe.

11. A dry pipe sprinkler system as claimed in claim 9, where the level sensing means is adapted to detect a change in the predetermined level of extinguishant in the control column and/or in the riser pipe.

12. A dry pipe sprinkler system as claimed in claim 11, wherein, on detecting a change in the predetermined level of extinguishant, the level sensing means is adapted to control the opening of the control valve.

13. A dry pipe sprinkler system as claimed in claim 12, wherein the level sensing means is adapted to send a signal to the control valve to cause it to open.

14. A dry pipe sprinkler system as claimed in claim 9, where the level sensing means comprises a probe that is linked to the control valve.

15. A dry pipe sprinkler system as claimed in claim 9, further comprising means for admitting extinguishant into the pipe system to keep extinguishant up to said predetermined level in the stand-by condition of the sprinkler system.

16. A dry pipe sprinkler system as claimed in claim 1, further comprising means for draining which is adapted to discharge extinguishant from the pipe system if the level of the extinguishant rises above said predetermined level in the stand-by condition of the sprinkler system.

17. A dry pipe sprinkler system as claimed in claim 1, where the diameter of the control column is less than that of the riser pipe.

18. A dry pipe sprinkler system as claimed in claim 1, wherein the pipe system comprises a first pipe sub-system and a second pipe sub-system, wherein the control column and the riser pipe are each connected between the first pipe sub-system and the second pipe sub-system.

19. A dry pipe sprinkler system as claimed in claim 18, wherein the first pipe sub-system is charged with extinguishant when the system is in its stand-by condition.

20. A dry pipe sprinkler system as claimed in claim 18, wherein the second pipe sub-system is charged with pressurised gas when the system is in its stand-by condition.

21. A dry pipe sprinkler system as claimed in claim 18, wherein the means for controlling pressure is installed in the second pipe sub-system.

22. A dry pipe sprinkler system as claimed in claim 18, wherein one or more anti-flooding devices are installed in the second pipe sub-system.

* * * * *